US006976609B2

(12) United States Patent
Konietzko

(10) Patent No.: US 6,976,609 B2
(45) Date of Patent: Dec. 20, 2005

(54) CONTAINER WITH SEAL ON THE CONTAINER LID

(76) Inventor: Albrecht Konietzko, Oberer Stephansberg 49g, 96049 Bamberg (DE)

( * ) Notice: Subject to any disclaimer, the term of this patent is extended or adjusted under 35 U.S.C. 154(b) by 35 days.

(21) Appl. No.: 10/476,089

(22) PCT Filed: Apr. 9, 2002

(86) PCT No.: PCT/EP02/03923

§ 371 (c)(1),
(2), (4) Date: Oct. 24, 2003

(87) PCT Pub. No.: WO02/087986

PCT Pub. Date: Nov. 7, 2002

(65) Prior Publication Data

US 2004/0118879 A1 Jun. 24, 2004

(30) Foreign Application Priority Data

Apr. 30, 2001 (DE) ..... 201 07 437 U

(51) Int. Cl.[7] ..... B67D 5/42

(52) U.S. Cl. ..... 222/389; 222/334; 222/542; 277/436

(58) Field of Search ..... 222/389, 386, 222/327, 334, 253, 258, 261, 542; 277/434, 277/436

(56) References Cited

U.S. PATENT DOCUMENTS

| | | | | | |
|---|---|---|---|---|---|
| 1,296,107 | A | * | 3/1919 | Oakley | 222/389 |
| 2,329,917 | A | * | 9/1943 | Lautmann | 221/76 |
| 2,753,892 | A | * | 7/1956 | Deardorff et al. | 138/31 |
| 3,176,595 | A | * | 4/1965 | Schwartz | 92/243 |
| 3,790,038 | A | * | 2/1974 | Kifer | 222/386 |
| 3,993,226 | A | * | 11/1976 | Pavenick | 222/327 |
| 4,234,108 | A | * | 11/1980 | Diamond | 222/386 |
| 4,347,943 | A | * | 9/1982 | Hackwell et al. | 220/792 |
| 4,671,431 | A | * | 6/1987 | Obrist | 222/327 |
| 4,858,759 | A | * | 8/1989 | Mauthe et al. | 206/221 |
| 5,215,229 | A | * | 6/1993 | Johnson | 222/209 |
| 5,397,178 | A | * | 3/1995 | Konietzko | 366/197 |

* cited by examiner

*Primary Examiner*—Frederick C. Nicolas
(74) *Attorney, Agent, or Firm*—Mark D. Wieczorek, Esq.

(57) ABSTRACT

The invention relates to a container for the storage and dispensing of paste-like or fluid masses, including a container body with side walls, an upper opening, a container lid, engaging the side walls from above, by means of a collar on the lid and sealing the upper opening of the container body with a lid plate. According to the invention, a circumferential narrow step is arranged on the outer edge of the inner side of the cover plate, with a free inclined flank face, directed towards the lid collar and the upper face of the side walls of the container body has an inclined contact surface, which lies on the flank face when the container lid is fitted. An undesired escape of the mass from the container lid can thus be prevented.

8 Claims, 3 Drawing Sheets

CONTAINER WITH SEAL ON THE CONTAINER LID

FIELD OF THE INVENTION

This invention relates to the arrangement of the sealing elements of a container for the storage and dispensing of paste-like and fluid masses, comprising a container body with side walls, an upper opening and a container lid engaging the side walls from above, by means of a collar on the lid and sealing the upper opening of the container body with a lid plate.

BACKGROUND OF THE INVENTION

In the pharmaceutical sector and in the production of cosmetic ointments or similar paste-like or fluid masses, small containers are used for the preparation and storage of these masses. The contents intended for these containers are often made as single formulations thus requiring empty containers to serve as storage containers for special preparations after or also during processing. Cylindrical containers are most commonly used, these are also called ointment tins or jars, and are closed using an screw-on type container lid.

A container with a screw cap und displaceable container bottom is known from EP 1 038 796 A2. Here for the preparation of the mass the shaft of a stirring tool is inserted inside the container by means of a dispensing opening in the screw cap. The bottom of this known container can be displaced, through the introduction of compressed air in a compressed air section, into a stocking section of the container in order to dispense the mass out of the dispensing opening. The necessary seal between the container bottom and the container wall is obtained by means of a seal lip. However, the quality of the seal in these containers does not appear to be sufficient. Undesired leakage of the mass from the container lid, the displaceable container bottom and the dispensing opening can especially result during the production and storage of relatively fluid masses. This can also lead to unacceptable deviations in the quality required for the composition of the mass to be produced, which especially in the pharmaceutical sector is unacceptable. Moreover, there is the risk associated with the contamination of the hands or clothes of the user when squeezing out the mass.

SUMMARY OF THE INVENTION

The task of this invention is to create a container featuring increased tightness in all displaceable and sealing regions, in particular in the region of the container lid. The container shall face the growing demand for hygienic and clean handling.

This task is solved by the container according to the invention in which a circumferential narrow step is arranged on the outer edge of the inner side of the cover plate with a free inclined flank face, directed towards the lid collar and in which the upper face of the side walls of the container body has an inclined contact surface, which lies on the flank face when the container lid is fitted.

The advantage of this invention lies in that in such a container paste-like and fluid masses can be produced in the exact quantity, loss-free and without dirt. When using the container for the storage and dispending on the mass, the dirtying of the user's hands or clothes as well as the contamination of the mass in the container due to the penetration of particles of dirt and germs are excluded.

The container according to the invention can be used for the production, storage and dispensing of most varying masses. In addition to the application in the pharmaceutical and cosmetic sector, specifically for the production of ointments and creams, it is also possible to use these containers to mix and store, among other things, different food products, greases, and soaps with suitable viscosity. The improved sealing quality makes the use of these containers even more comfortable.

In a first embodiment of the invention for the development of the circumferential step a first circumferential notch is arranged on the inner side of the cover plate where, depending on the material, the structure of the step is so narrow that it is easily deformable as a result of a pressure increase in the closed container. Therefore, the step works as a particularly flexible sealing lip significantly increasing the sealing effect.

In a particularly preferred embodiment of the container, the container lid has a cylindrical dispensing opening in a dispensing case raising above the lid plate and a sealing lip is created at the inner end of the dispensing case by means of a second circumferential notch inserted into the wall of the dispensing case in an axial direction. In this case, the dispensing opening is preferably arranged centrally in the container lid, adjusted to the shaft of a stirring tool and sealable through a locking cap.

In a preferred embodiment the container according to the invention is made of plastic so that the container body can be produced with existing die-casting processes.

A modified embodiment distinguishes itself by the fact that it has a displaceable container bottom which subdivides the container body into a stocking section to receive the paste-like and fluid mass and a compressed air section, where a sealing lip is formed by means of a third circumferential notch at the outer edge of the surface of the container bottom directed towards the stocking section. In this way, the seal in the region of the bottom plate is also improved, which is particularly advantageous when the container has an integrated element for the production of compressed air which forces the compressed air into the compressed air section in order to squeeze the mass out of the dispensing opening.

The features according to the invention allow for the structuring of containers of different capacities. Normally, so called jars having a capacity from 15 to 200, 300 or 500 ml. Modified embodiments of this invention have a displaceable container bottom, which can be displaced into the stocking region manually with the thumb or by means of a pushing tool (a spindle for example) in order to dispense the dosed mass.

BRIEF DESCRIPTION OF THE DRAWINGS

Other advantages and characteristics of the invention emerge from the following description with reference to the drawings showing.

DETAILED DESCRIPTION

Figure 1:
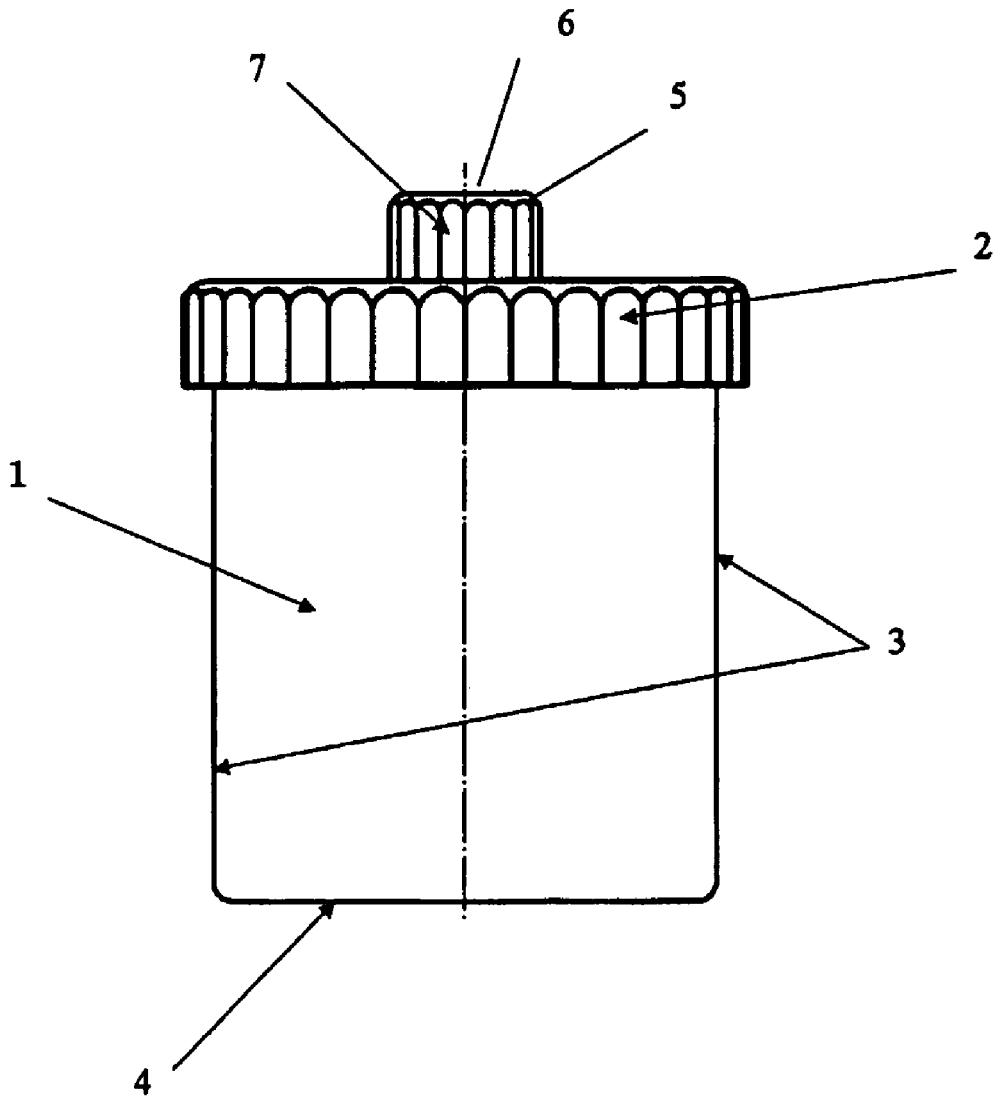
FIG. 1 a side view of a container according to the invention.

FIG. 1 shows a side view of a container according to the invention for the production, storage and dispensing of paste-like and fluid masses. This is a cylindrical container in which the external and/or internal shape can be replaced by other embodiments according to the desired purpose. The container consists of a container body 1 and a container lid 2. The container body 1 has side walls 3 running parallel to each other. A container bottom 4 closes the container downwards.

Figure 3:
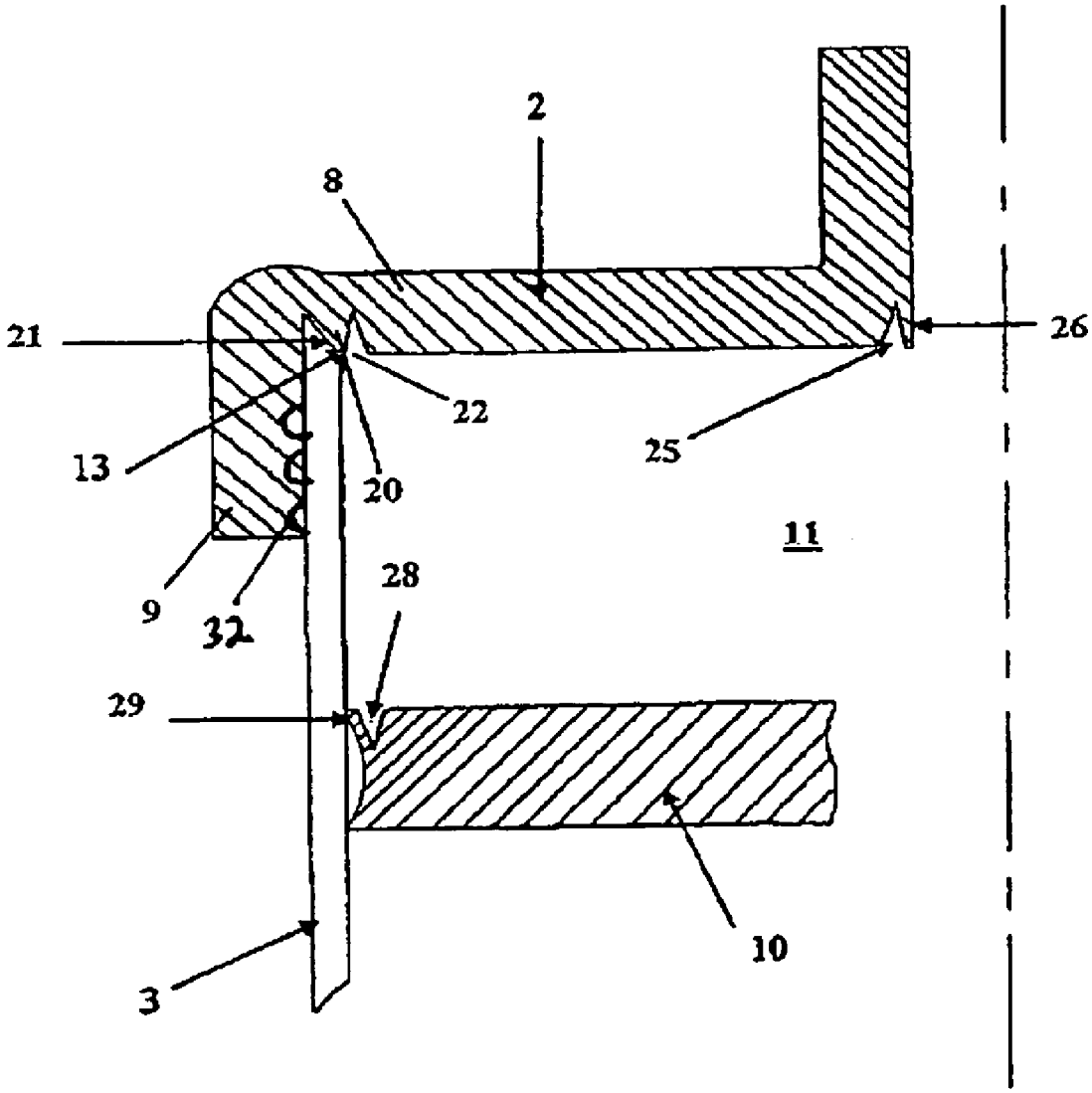
FIG. 3 an enlarged sectioned view of a detail of the container depicted in FIGS. 1 and 2.

The container body 1 and the container lid 2 are, by way of example, connected to each other by means of a thread 32 (see FIG. 3). A plug connection or the like would also be suitable. At the centre of the container lid 2 there is a dispensing case 5 with a dispensing opening, which is covered by a locking cap 7.

Figure 2:
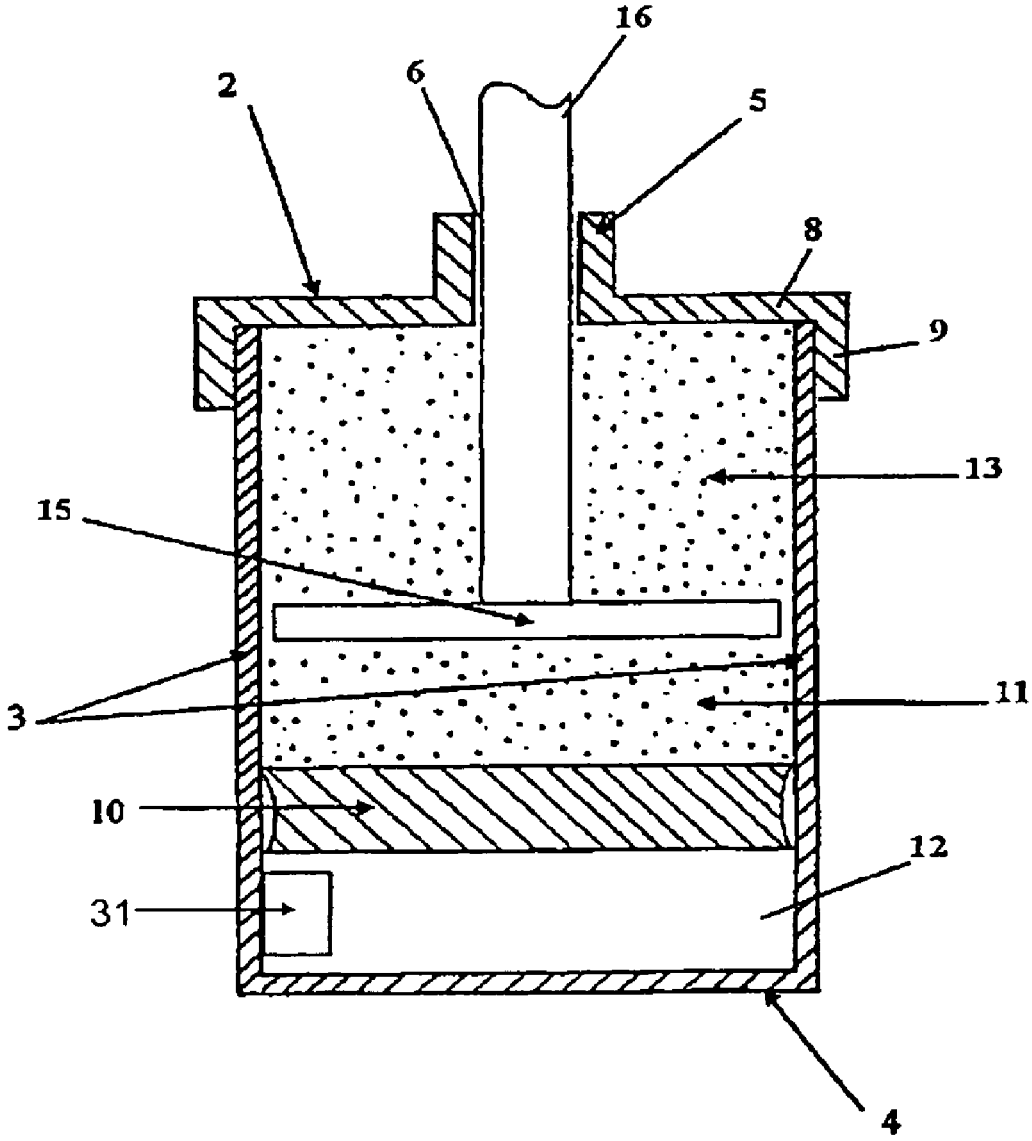
FIG. 2 a sectioned side view of the container depicted in FIG. 1.

FIG. 2 shows a sectioned side view of the container. The container lid 2 has a container plate 8 and a container collar 9 engaging the side walls 3 of the container body. In the depicted embodiment a displaceable bottom plate 10 separates an upper stocking section 11 from a lower compressed air section 12. For the dispensing of the paste-like or fluid mass 13 contained in the stocking section 11 an over pressure is produced by means of a internal compressed-air producing means 31 internal or one external to the compressed air section (not shown), so that the bottom plate 10 is displaced into the stocking section 10.

For the production of the mass 13 in the container, a stirring system can be inserted into the stocking section 11 from above through the dispensing opening 6. The stirring system has an adapted stirring tool 15 and a shaft 16.

FIG. 3 shows an enlarged sectioned detail view of the container depicted in FIGS. 1 and 2. To prevent the loss of tightness between the side walls 3 and the container lid 2, a circumferential narrow step 20 is arranged on the outer edge of the inner side of the cover plate 8. The step 20 has a free inclined flank face, directed towards the lid collar 9, which lies on an inclined contact surface 21 of the face of the side wall 3 of the container body when the container lid is fitted. The inclined flank face of the step 20 and the contact surface 21 form the actual sealing area. In order for these two inclined surfaces to cling to each other perfectly the step 20 must be structured on purpose to be slightly twistable. To this end, the step 20 is formed in such a way that a circumferential notch is inserted into the material at the outer notch of the inner side of the cover plate. The step 20 works like a sealing lip which is an integral part of the lid plate 8. The sectional shape of the step 20 and the notch 22 can be adjusted to the intended use and to the tools available. If the step 20 is thin enough and therefore deformable, in case of increased inner pressure in the stocking section 11 this pressure also has an effect on the notch 22 and pushes the step 20 towards the contact surface 21.

In order obtain an improved sealing between the dispensing case 5 and the stirring tool 5 during the preparation process, a second notch 25 is inserted into the wall of the dispensing case in an axial direction on the inner end of the dispensing case 5. This creates a sealing lip 26 clinging to the stirring tool's shaft 15 with the stirring tool inserted and preventing the escape of the mass.

The seal between the displaceable container bottom 10 and the side walls 3 is structured in a similar way. To this end, a third circumferential notch 28 is arranged on the outer edge of the surface of the container bottom 4 directed towards the stocking section 11 resulting in an additional sealing lip 29. Through the third notch 28 the sealing lip 26 becomes thin enough to cling to the side walls 3 of the container body in a flexible manner. Since the mass is forced also into the third notch 28, an increased pressure in the stocking section 11 also results in an improved sealing effect.

In general the use of the notches conveys additional flexibility to the step and the sealing lips 20, 26 and 29. The increased flexibility of the sealing lips results in a significant rise in the sealing quality and pressure resistance.

What is claimed is:

1. A container for the storage and dispensing of materials having a consistency substantially the same as paste or fluid masses comprising:

a container body with side walls and an upper opening defining a stocking section; and a container lid engaging the side walls from above by means of a collar on the lid and sealing the upper opening of the container body with a lid plate;

such that a circumferential narrow step is arranged on the outer edge of the inner side of the lid plate, with a free inclined flank face directed towards the lid collar and such that the upper face of the side walls of the container body has an inclined contact surface, which lies on the flank face when the container lid is fitted; and such that, in order to form the circumferential step, a first circumferential notch is arranged on the inner side of the lid plate, where the step is narrow enough, such that, depending on a material of the container lid, the step is easily deformable by a pressure increase in the stocking section; such that the container lid has a cylindrical dispensing opening in a dispensing case raising above the lid plate and such that a sealing lip is created at the inner end of the dispensing case by means of a second circumferential notch inserted into the wall of the dispensing case in an axial direction, clinging to a stirring tool's shaft inserted inside the container through the dispensing case.

2. The container according to claim 1, such that the dispensing case is arranged centrally on the container lid and is closed by means of a locking cap.

3. The container according to claim 1, further comprising a displaceable container bottom sub-dividing in the container body and the stocking receiving the paste or fluid masses, where an additional sealing lip is formed on the outer edge of the surface of the container bottom directed towards the stocking section by means of a third circumferential notch.

4. The container according to claim 3, such that beneath the displaceable container bottom a compressed air section is arranged into which compressed air is pressed for the displacement of the container bottom.

5. The container according to claim 4, such that the displaceable container bottom is reached from below for the displacement.

6. The container according to claim from 3, such that the container body, the container lid and the displaceable container bottom are made of an elastic plastic material.

7. The container according to claim 4, further comprising an integrated compressed-air producing element pressing the paste or fluid masses contained in the stocking section into the compressed air section.

8. The container according to claim 1, such that the container lid is connected with the container body by a thread arranged on the lid collar and on the side walls.

* * * * *